US005697565A

United States Patent [19]

Zitzen

[11] Patent Number: 5,697,565

[45] Date of Patent: Dec. 16, 1997

[54] CREEL RELIEF DEVICE FOR A YARN WINDING APPARATUS

[75] Inventor: Wilhelm Zitzen, Mönchengladbach, Germany

[73] Assignee: W. Schlafhorst AG & Co., Moenchengladbach, Germany

[21] Appl. No.: 714,648

[22] Filed: Sep. 16, 1996

[30] Foreign Application Priority Data

Sep. 15, 1995 [DE] Germany ..... 195 34 333.6

[51] Int. Cl.[6] ..... B65H 54/00

[52] U.S. Cl. ..... 242/18 DD; 242/541.5

[58] Field of Search ..... 242/18 DD, 39, 242/541.5, 596.8

[56] References Cited

U.S. PATENT DOCUMENTS

| | | | |
|---|---|---|---|
| 3,510,078 | 5/1970 | Tsukuma et al. . | |
| 3,777,995 | 12/1973 | Funaioli et al. | 242/18 DD |
| 3,991,950 | 11/1976 | Tashiro et al. | 242/18 DD |
| 4,102,506 | 7/1978 | Raasch et al. | 242/18 DD |
| 4,140,286 | 2/1979 | Lattion | 242/18 DD |
| 5,409,173 | 4/1995 | Fahmuller et al. | 242/18 DD |

FOREIGN PATENT DOCUMENTS

| | | | |
|---|---|---|---|
| 2006092 | 4/1969 | France . | |
| P.A. 127411 | 7/1967 | Germany . | |
| 1 952 726 | 6/1970 | Germany . | |
| 2 320 754 | 11/1973 | Germany . | |
| 25 18 646 C2 | 8/1986 | Germany . | |
| 39 11 854 C2 | 9/1989 | Germany . | |
| 41 21 775 A1 | 1/1993 | Germany . | |
| 47-7219 | 3/1972 | Japan | 242/18 DD |
| 898038 | 6/1962 | United Kingdom | 242/18 DD |
| 1168697 | 10/1969 | United Kingdom . | |

*Primary Examiner*—Michael Mansen

*Attorney, Agent, or Firm*—Kennedy Covington Lobdell & Hickman, LLP

[57] ABSTRACT

A creel relief device (1) for exerting a relatively constant pressure of a cheese (24) on a yarn guide drum (6) in a textile cheese producing machine over the course of building the wound diameter of the cheese. The creel relief device (1) has two meshing toothed segments (10 or 14) respectively disposed on lever elements (8 or 15), one lever element (8) being connected with the creel shaft (7) securely against rotation relative thereto, while the other lever element (15) is pivotably mounted to be acted upon by a prestressed tension spring (19) extending between the lever element (15) and a setting lever (21), which can be locked in different positions for predetermining torque to be applied to the creel.

6 Claims, 4 Drawing Sheets

CREEL RELIEF DEVICE FOR A YARN WINDING APPARATUS

FIELD OF THE INVENTION

The present invention relates generally to a creel relief device for the yarn winding apparatus of a textile machine of the type which producing cheeses and, more particularly, to such a device having a force applying means engaging the creel for pressing the cheese held in the creel against the yarn guide drum at the start of a bobbin winding operation and for urging the cheese in the opposite direction in the course of the completion of the bobbin winding operation.

BACKGROUND OF THE INVENTION

Textile cheese producing machines having various embodiments of such winding apparatus with a creel relief device are known. The creel relief device essentially accomplishes two objectives. On the one hand, it is used to set the pressure exerted by the cheese on the yarn guide drum and, on the other, for compensating for the increasing weight of the cheese as it becomes progressively larger over the course of winding thereof. Since the pressure exerted by the creel relief device on the cheese, along with the prevailing yarn tension, determines the yarn density of the cheese, it is attempted to keep the exerted pressure approximately constant during the entire bobbin winding operation.

German Patent Publication No. DE 25 18 646 C2 discloses a cheese winding apparatus wherein the cheese is disposed above a yarn guide drum and the creel is arranged so that its center of gravity acts in the direction toward the yarn guide drum. At the beginning of the bobbin winding operation, the exerted pressure is reinforced by means of an element which performs a combined load-producing and load-relieving function, preferably by means of a pressure spring supported at a setting angle to act on a lever shoulder. Thus, at the start of the bobbin winding the effective line of force exerted by the pressure spring is first located in back of the frame axis and exerts a torque acting counterclockwise, which leads to an additional exertion of pressure of the tube on the yarn guide drum.

As the winding of yarn on the cheese progressively increases its diameter, the winding frame pivots into a position in which the effective line of force exerted by the pressure spring at first lies at the same height as the frame axis. In this position the pressure exerted on the yarn guide drum by the cheese itself and the spring force of the load-producing and load-relieving elements oppose and cancel each other. With continued increase of the wound diameter of the cheese, the effective line of force by the pressure spring moves ahead of the frame axis and serves to apply a torque to the creel in a clockwise direction, thereby relieving the creel of the weight of the cheese on the yarn guide drum.

The creel relief device described above has been proven in a somewhat modified embodiment in actual use and is used in many cases. However, this device has the disadvantage that the pressure exerted at the individual winding stations is set centrally by means of a continuous adjusting rail, which pivots the adjusting angles for the pressure springs respectively arranged in the area of the winding stations.

Another device for controlling the pressure exerted by a cheese in a winding apparatus is known from German Patent Publication No. DE 39 11 854 C2, wherein the exerted pressure is controlled by means of a pneumatic thrust piston drive acting on an arm of the creel. In this device, the piston drive is controlled to exert an optimum pressure on the creel arm determined in relation to the respective diameter of the cheese according to a predetermined exerted pressure correction curve. The determination of the instantaneous cheese diameter is performed in this case based on calculation of the rpm ratio between the yarn guide drum and the cheese. This known device as a whole is relatively elaborate and complicated and therefore correspondingly expensive.

A further creel relief device is known from German Patent Publication No. DE 41 21 775 A1, wherein a mechanical load-producing element as well as a double-acting pneumatic cylinder act on the creel. The pneumatic cylinder is connected to two compressed air systems which respectively have different pressure levels to enable it either to exert a load on the creel or to relieve it, as determined according to a related control.

OBJECT AND SUMMARY OF THE INVENTION

It is accordingly an object of the present invention to provide an improved creel relief device of the basic type described above.

This object is attained in accordance with the present invention by a novel creel relief device utilized in a textile machine having an apparatus for winding yarn into cheeses wherein the winding apparatus including a rotatable yarn guide drum, a creel shaft, and a creel pivoted on the creel shaft for supporting a cheese in frictional driven contact with the drum during winding. The present creel relief device basically serves the function of applying a force to the creel for controlling contact pressure of the cheese against the yarn guide drum over the course of winding the cheese to exert positive contact pressure during a beginning stage of cheese winding and to exert a negative contact pressure during a subsequent stage of cheese winding. According to the present invention, this creel relief device comprises a first lever element connected to the creel shaft against rotation relative thereto, a second pivotable lever element, first and second toothed segments disposed respectively on the first and second lever elements in meshing engagement with each other, a setting lever selectively pivotable between plural fixed positions, and a spring connected under tension between the second lever element and the setting lever to apply a torque to the second lever element according to the selected position of the setting lever.

The creel relief device in accordance with the present invention offers the advantage that the device is constructed with its operating elements well arranged in a compact and very functional manner. The preferred use of exchangeable toothed segments assures a transfer of the torque acting on the lever elements which is almost free of play, as well as providing a long service life of the device. With the employment of exchangeable toothed segments there is the further possibility of flexibly matching the exerted bobbin pressure to special winding conditions.

The preferred use of a pre-stressed tension spring as the load-exerting means provides the advantage of being a relatively inexpensive and commercially available component along with offering a long service life because of its freedom from wear. The spring arrangement also makes it possible in a simple manner to set the relief device in such a way that hard, medium or soft cheeses (i.e., the yarn density of the cheese) can be selectively produced.

In one contemplated embodiment, the toothed segments have the same reference circle diameters which dependably assures that the pressure exerted on the bobbin remains almost constant during the entire bobbin winding operation. However, it can also be desirable to operate with an exerted bobbin pressure which changes in the course of the bobbin winding operation. In this case an embodiment wherein the toothed segments have different reference circle diameters may be utilized.

More specifically, an embodiment in which the toothed segment of the first lever element has a reference circle diameter which is greater than the reference circle diameter of the toothed segment of the second lever element enables the pressure exerted on the bobbin to be reduced with increasing cheese diameter. In this case the amount of the change of the pressure exerted on the bobbin can be predetermined by an appropriate selection of toothed segments with different reference circle diameters.

An embodiment which further comprises a damping cylinder having a piston rod projecting therefrom with the first lever element being pivoted to the piston rod assures that oscillations caused by the cheeses rotating on the yarn guide drum are suppressed to the greatest extent at the start, which has an advantageous effect on the quiet running of the winding apparatus and thus on the formation of the yarn winding on the cheese as a whole.

Further details of the invention will be understood from an exemplary embodiment explained below by means off the drawings.

DETAILED DESCRIPTION OF THE PREFERRED EMBODIMENT

Figure 1:
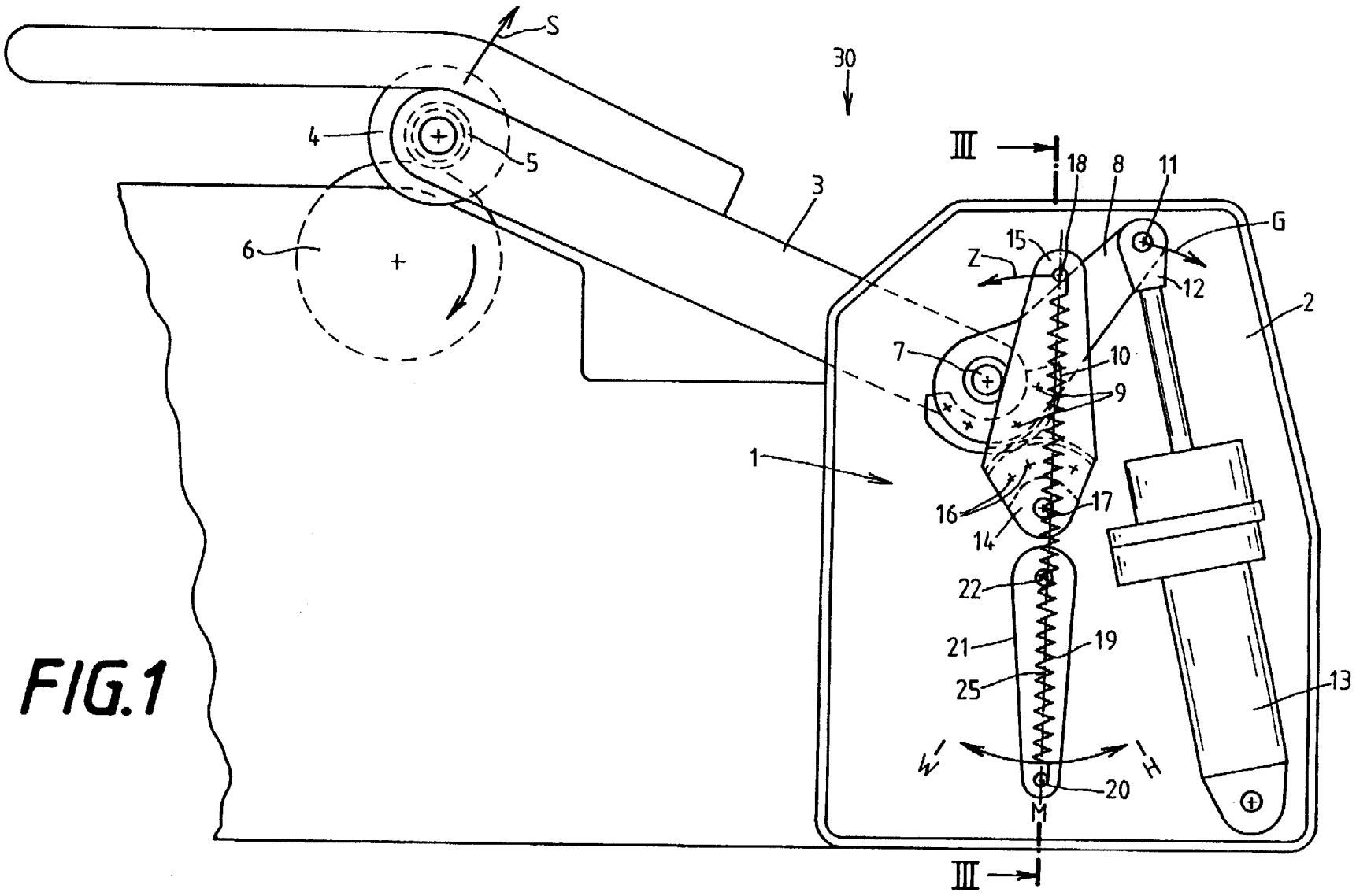
FIG. 1 is a lateral view of a creel relief device in accordance with a preferred embodiment of the present invention, shown at the start of the cheese winding process.

Referring now to the accompanying drawings and initially to FIG. 1, a single winding station 30 of a textile yarn handling machine is shown in a lateral view. The winding station 30 has a housing 2 which is partially open. As is customary, a creel 3 is supported by the winding station housing and has a pair of creel arms each carrying tube holders 4 between which a tube 5 is rotatably supported in resting engagement on a rotatably driven yarn guide drum 6 to be driven in turn by the drum 6 by means of frictional contact therewith.

The creel 3 is pivotably seated in the winding station housing 2 on a frame shaft 7. A creel relief device, identified overall at 1, is also provided in the creel housing 2 and has a lever element 8 seated securely against relative rotation on the frame shaft 7. The opposite end of the lever element 8 is connected by means of a bolt connection 11 with the outward head end of a piston rod 12 of a damping cylinder 13. In addition, a toothed segment 10 is removably fastened on the lever element 8 by means of threaded bolts 9 or the like. The toothed segment 10, which is preferably made of plastic, for example polyamide or the like, has, for example, the module 2 (in accordance with the module sequence DIN 780) and a reference circle diameter (TK) of 60 mm.

The toothed segment 10 meshes with a corresponding, preferably exchangeable, toothed segment 14 which is fastened on a lever element 15 by means of threaded bolts 16 or the like. In the illustrated embodiment, the segments 10 and 14 have generally comparable reference circle diameters, but both segments are exchangeable to allow different segment diameters to be selectively employed. The lever element 15 is seated to be partially pivotable on a pivot shaft 17 supported by the winding station housing 2 and the opposite end of the lever element 15 has a fastening pin 18 for attaching a load means 19.

Figure 3:
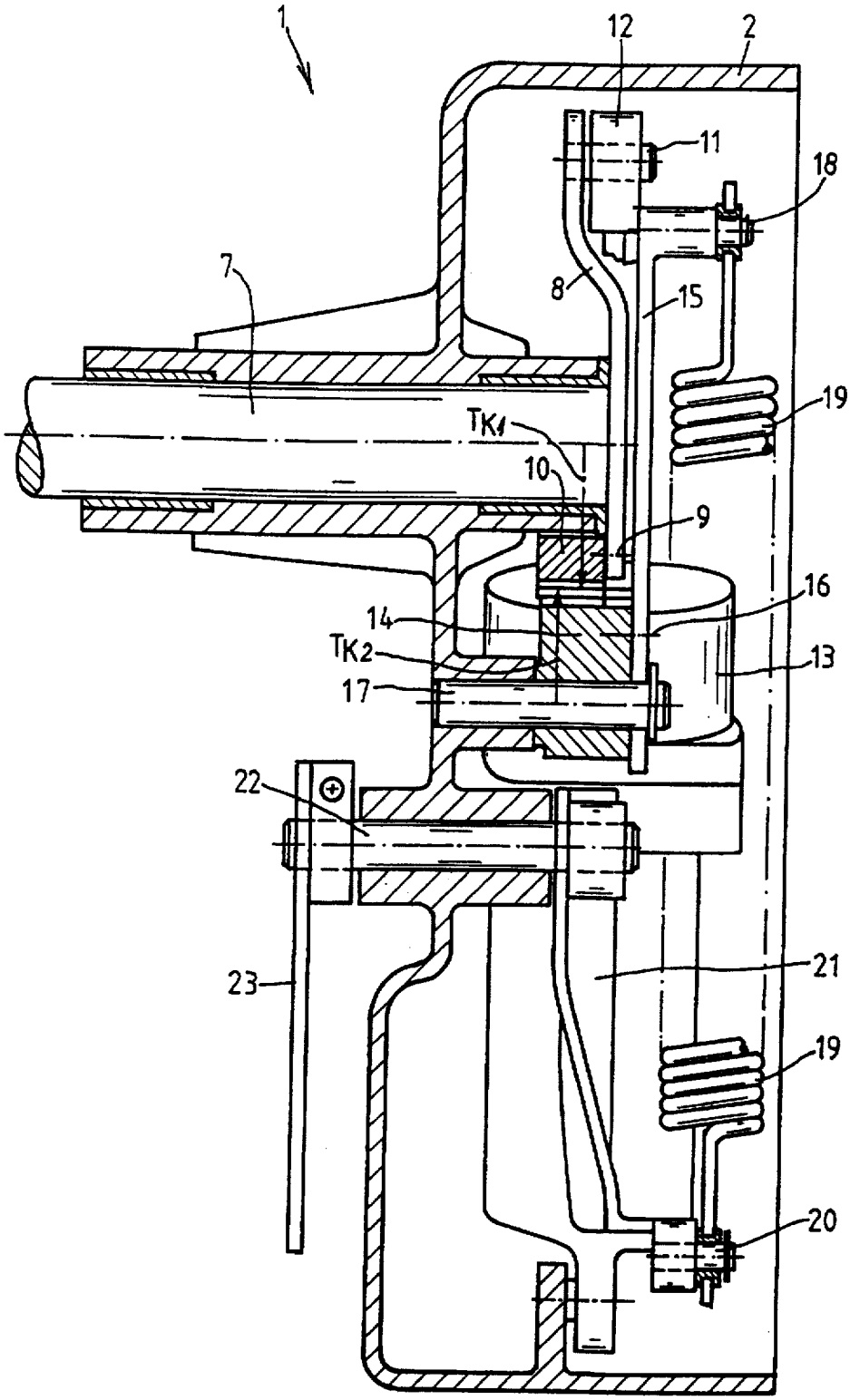
FIG. 3 is a vertical cross sectional view of the creel relief device of FIG. 1 taken along the section line III—III therein, showing the setting lever placed in the "hard" position.

The load means 19 is a tension spring in the preferred embodiment illustrated and is also attached at its end opposite the fastening pin 18 on a load pin 20 fastened on the end of a setting lever 21. The setting lever 21 is selectively pivotable in clockwise and counterclockwise directions around a pivot shaft 22. A pivot element 23 (see FIG. 3) is disposed on the pivot shaft 22 on the outside of the winding station housing 2 and has an associated dial for setting the desired cheese hardness.

The operation of the present creel relief device may thus be understood. FIG. 1 represents the starting position at the beginning of a cheese winding operation. In the exemplary embodiment, the setting lever 21 is fixed in the position M (to determine a "medium hard" bobbin), i.e., the setting level 21 is in a vertical position. The lever element 15, pivotably seated on the pivot shaft 17 in the winding station housing 2 above the setting lever 21, is thereby inclined in a clockwise direction by a few degrees from the vertical. Thus, the effective line of force 25 exerted by the tension spring 19 interposed between these two lever components 15,21 extends to the right (as viewed in FIG. 1) adjacent to the pivot shaft 17 of the lever element 15, thereby to apply a torque acting in a clockwise direction on the lever element 15. This torque is transmitted, in turn, via the toothed segments 14,10 and via the lever element 8 to the pivot shaft 7 of the creel 3, thereby causing the creel arms to press the tube 5 on the yarn guide drum 6 under the effect of this torque. In this case, the pressure force transmitted via the torque has been selected to prevent as much as possible slippage of the tube 5 as it is driven by frictional connection by the yarn guide drum 6.

As the cheese diameter increases progressively as yarn is wound on the tube 5, the creel 3 gradually pivots around the creel shaft 7 in the direction of the arrow S. In the process, the lever element 8 as well as the toothed segment 10 fixed on the lever element 8 are also pivoted in the direction of the arrow G. Since the toothed elements 14 and 10 are operationally meshed, the gradual elevation of the creel 3 in the direction of the arrow S causes pivoting of the lever element 15 in the direction of the arrow Z. Thus, the effective line of force 25 exerted by the tension spring 19 gradually moves in a counterclockwise direction toward the pivot shaft 17, and in the process the effective lever arm for the transmitted torque is shortened. At the time when the effective line of spring force 25 extends through the pivot shaft 17, the lever arm accordingly reaches a zero length, whereupon there is no active torque being exerted.

Figure 2:
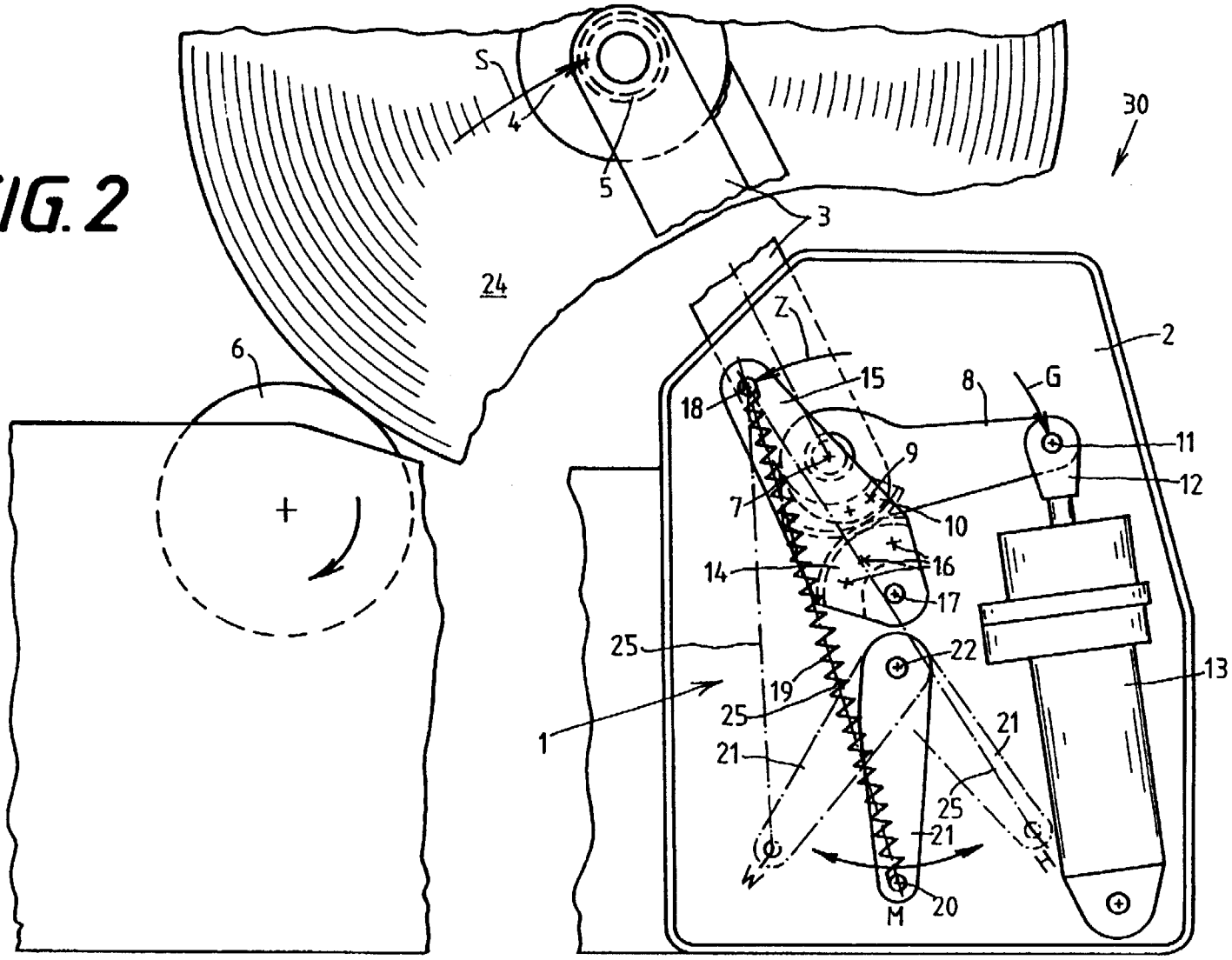
FIG. 2 is another lateral view of the creel relief device of FIG. 1, but shown at the completion of the cheese winding process.

In the course of building the cheese, the increasing diameter of the cheese 24 ultimately pivots the lever element 15 into the end position represented in FIG. 2. Thus, after passing through the above-described neutral position (wherein the effective line of force of the tension spring 19 extends through the pivot shaft 17), the spring force of the tension spring 19 begins to progressively create a torque on the lever element 15 which, however, is now active in a counterclockwise direction. This torque acting counterclockwise on the pivot element 15 is transmitted via the toothed segments 14 and 10 and the lever element 8 to the creel shaft 7, so that now a moment acting counter to the bobbin weight is applied to the creel 3. Since the active lever arm now progressively increases with increasing bobbin diameter, the effective torque also increases, so that the increasing bobbin weight is continuously compensated.

Figure 4:
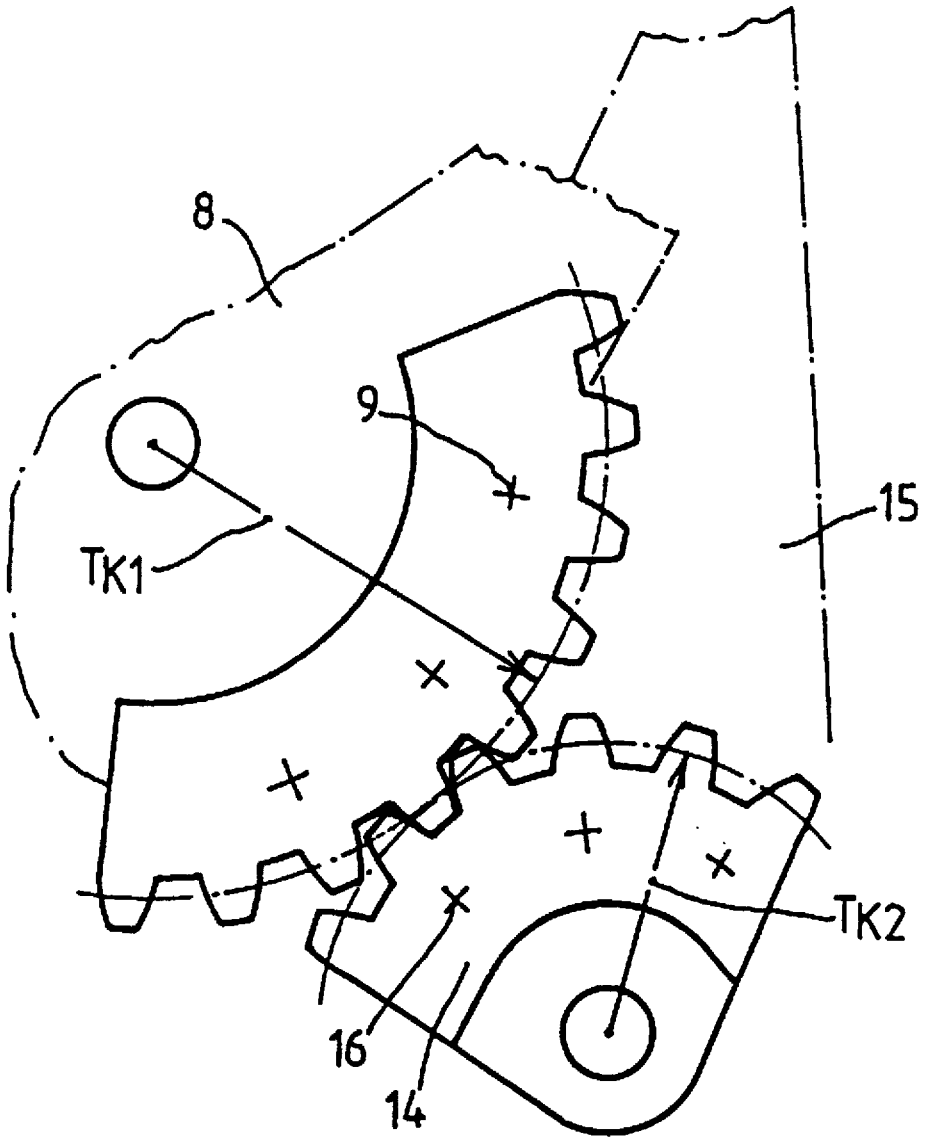
FIG. 4 depicts another arrangement of toothed segments in the present creel relief device, showing the use of different reference circle diameters of the segments in operational connection.

In this embodiment, the density of the bobbin can be selectively adjusted by the initial setting of the lever 21 at the beginning of the winding process between the position H (to achieve a "hard," i.e., relatively densely wound, cheese) and the position W (to achieve a relatively soft, less densely wound cheese). It is further possible to affect the course of the torque, i.e., the effective pressure exerted on the bobbin, by a suitable selection of the toothed segments 14,15, for example by employing toothed segments with different reference circle diameters TK1 and TK2 as shown in FIG. 4.

As a whole, the device in accordance with the invention advantageously provides a mechanism with a long service life, by means of which the bobbin structure of cheeses can be positively affected in a relatively simple way.

It will therefore be readily understood by those persons skilled in the art that the present invention is susceptible of a broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. In a textile machine having an apparatus for winding yarn into cheeses, the winding apparatus including a rotatable yarn guide drum, a creel shaft, and a creel pivoted on the creel shaft for supporting a cheese in frictional driven contact with the drum during winding, a creel relief device for applying a force to the creel for controlling contact pressure of the cheese against the yarn guide drum over the course of winding the cheese to exert positive contact pressure during a beginning stage of cheese winding and to exert a negative contact pressure during a subsequent stage of cheese winding, the creel relief device comprising a first lever element connected to the creel shaft against rotation relative thereto, a second pivotable lever element, first and second toothed segments disposed respectively on the first and second lever elements in meshing engagement with each other, a setting lever selectively pivotable between plural fixed positions, and a spring connected under tension between the second lever element and the setting lever to apply a torque to the second lever element according to the selected position of the setting lever.

2. A cheese producing textile machine with a creel relief device in accordance with claim 1, wherein the toothed segments are releasably fastened on the lever elements.

3. A cheese producing textile machine with a creel relief device in accordance with claim 1, wherein the toothed segments have the same reference circle diameters.

4. A cheese producing textile machine with a creel relief device in accordance with claim 1, wherein the toothed segments have different reference circle diameters.

5. A cheese producing textile machine with a creel relief device in accordance with claim 1, wherein the toothed segment of the first lever element has a reference circle diameter which is greater than the reference circle diameter of the toothed segment of the second lever element.

6. A cheese producing textile machine with a creel relief device in accordance with claim 1, and further comprising a damping cylinder having a piston rod projecting therefrom, the first lever element being pivoted to the piston rod.

* * * * *